US005277335A

United States Patent [19]

Okami et al.

[11] Patent Number: 5,277,335

[45] Date of Patent: Jan. 11, 1994

[54] OVAL TUBE PRESS

[76] Inventors: Alvin S. Okami, 744 Kohou St., Honolulu, Hi. 96817; Denny W. Kwock, 2756 Woodlawn Dr., Ste. 6-200, Honolulu, Hi. 96822-1856

[21] Appl. No.: 801,927

[22] Filed: Dec. 3, 1991

[51] Int. Cl.[5] ..... B65D 35/28

[52] U.S. Cl. ..... 222/102; 222/103

[58] Field of Search .....222/101; 103

[56] References Cited

U.S. PATENT DOCUMENTS

| | | | |
|---|---|---|---|
| 1,386,966 | 8/1921 | Slade | 222/102 |
| 1,479,101 | 1/1924 | Legendre | 222/102 |
| 1,773,104 | 8/1930 | Johnson | 222/102 |
| 1,983,462 | 12/1934 | Johnson | 222/102 X |
| 1,998,232 | 4/1935 | Gould . | |
| 2,037,138 | 4/1936 | McConnon . | |
| 2,129,627 | 9/1938 | Sands et al. . | |
| 2,179,012 | 11/1939 | Kach | 222/102 X |
| 2,196,786 | 4/1940 | Wahl . | |
| 2,471,825 | 5/1949 | Long . | |
| 2,502,081 | 3/1950 | Flynn et al. | 222/102 X |
| 2,551,176 | 5/1951 | Smith . | |
| 2,901,147 | 8/1959 | Bond | 222/102 |
| 3,081,056 | 3/1963 | Young et al. . | |
| 3,085,716 | 4/1963 | Trattler . | |
| 3,197,072 | 7/1965 | Dick | 222/102 |
| 3,257,039 | 6/1966 | Trutza . | |
| 3,262,605 | 7/1966 | Madden . | |
| 3,281,016 | 3/1965 | Thompson . | |
| 3,536,234 | 10/1970 | Rise | 222/103 |
| 4,159,787 | 7/1979 | Wright | 222/103 |
| 4,337,879 | 7/1982 | Park | 222/102 |
| 4,359,173 | 11/1982 | Williams . | |
| 4,405,062 | 9/1983 | Tschida, Sr. | 222/103 X |
| 4,448,333 | 5/1984 | Ferrari | 222/103 X |
| 4,576,314 | 3/1986 | Elias et al. . | |
| 4,599,758 | 7/1986 | Stiles | 222/103 X |
| 4,672,703 | 6/1987 | Frazier . | |
| 4,778,082 | 10/1988 | Vitelle | 222/103 X |
| 5,131,567 | 7/1992 | Lipsey | 222/102 |
| 5,167,348 | 12/1992 | Okami et al. | 222/103 |

FOREIGN PATENT DOCUMENTS

| | | | |
|---|---|---|---|
| 466853 | 7/1927 | Fed. Rep. of Germany | 222/102 |
| 830828 | 2/1952 | Fed. Rep. of Germany | 222/102 |
| 820722 | 11/1937 | France | 222/102 |
| 444344 | 1/1949 | Italy | 222/102 |
| 446267 | 3/1949 | Italy . | |
| 362182 | 7/1962 | Switzerland . | |
| 2071602 | 9/1981 | United Kingdom . | |
| 9109783 | 7/1991 | World Int. Prop. O. | 222/102 |

*Primary Examiner*—Andres Kashnikow
*Assistant Examiner*—Kenneth DeRosa

[57] ABSTRACT

The present invention is a tube press designed to squeeze excess toothpaste, ointments, and similar materials trapped at the bottom of a collapsible tube dispenser. Two rods having oblongated cross-sections are positioned in parallel and have notches to guide and hold two bands or O-rings at each end. The rods have preferred cross-sections of ellipses or football shapes. A tube-receiving slot is formed by gradual slopes towards a nip. The bands or O-rings provide pressure against the tube which is sandwiched between the two rods within the nip. Sliding the whole assembly up the length of the tube forces the residual contents to the top.

12 Claims, 4 Drawing Sheets

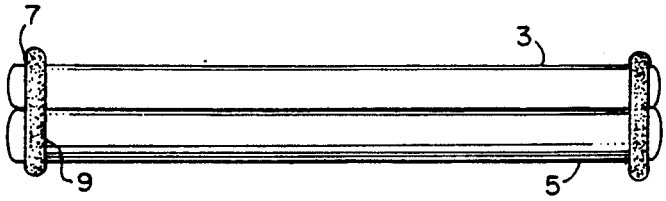
FIG. 1
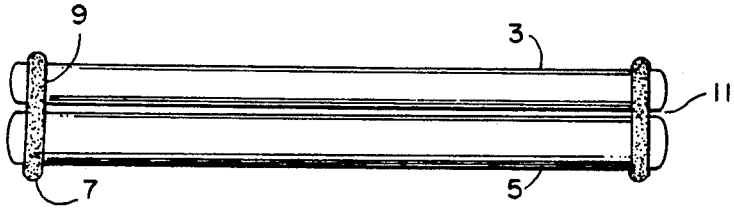
FIG. 2
FIG. 3
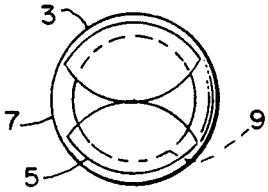
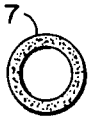
FIG. 4
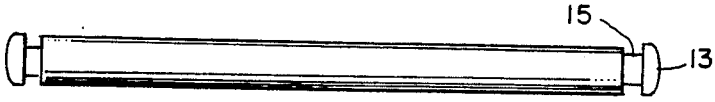
FIG. 5

FIG. 6
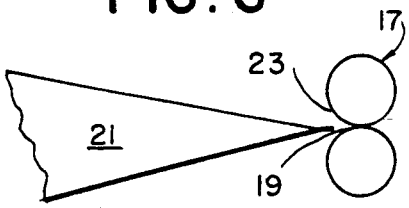
FIG. 7
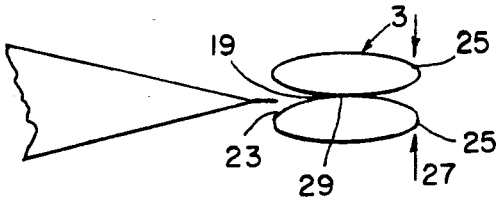
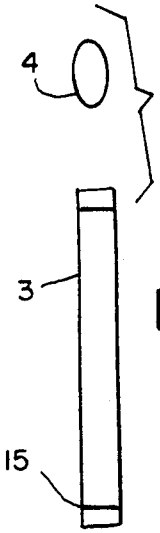
FIG. 8a
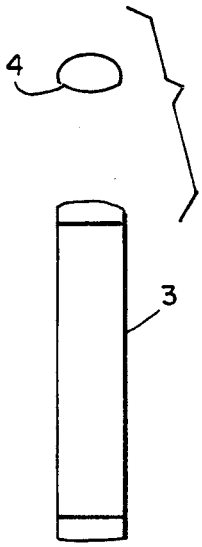
FIG. 8b
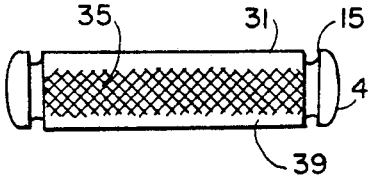
FIG. 9a
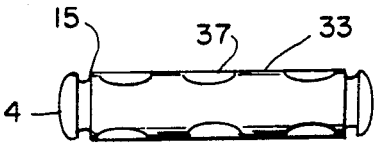
FIG. 9b
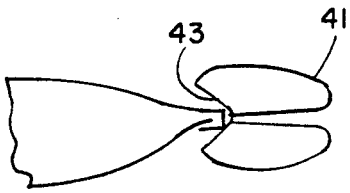
FIG. 10a
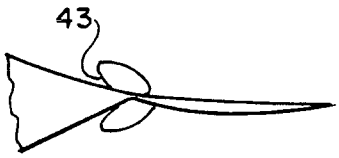
FIG. 10b

OVAL TUBE PRESS

BACKGROUND OF THE INVENTION

The present invention relates to tube presses. The invention is a novel design for a tube press. It is designed to be used with various products that come in tubes such as toothpaste, ointments, glue, etc. It is a common problem for anyone using toothpaste, or any other item dispensed by manually squeezing a plastic tube, to have the contents of the tube spread throughout the tube, and in particular to the closed bottom end of the tube when the user is attempting to dispense the contents. The problem becomes greater as the tube becomes less full. It is the object of the present invention to provide assistance to the manual dispensing of material contained within such tubing. It is a further object of the present invention to prohibit the contents of a collapsible tube dispenser from spreading to the closed end of the tube, gathering the contents towards the open end and making each successive discharge of a portion of the tubes contents as easy as the first.

A number of devices have been designed that attempt to perform the same function as the present invention. However, most prior inventions are relatively complex and contain several component parts. The present invention is simple and easy to use. Some fairly simple devices have also been designed, but these are typically of a construction having a fixed gap width through which the tube is inserted. Devices of the fixed gap width design commonly make it difficult to initially insert the closed end of a tube. Also, depending on the tube and its contents, the fixed gap width either leaves a small amount of the contents in the end which should be empty, or creates too tight a fit for the device to effectively be slid along the length of the tube. It is an object of the present invention to overcome these problems in the prior art.

The present invention works well on the new plastic type tubes. When old turnkey style presses (which squeezes the tube by rolling it) are used on a new plastic tube, the tube tends to unroll and the key type press becomes ineffective and much more difficult to use than the present tube press.

With the present invention, the tube remains flat throughout. With the key type presses, the tube is slowly rolled up. This may be considered unsightly and may make the tube harder to store (such as sitting in a cup).

The inventor's parent application, now patented, provided a tube press having parallel, abutting rods with circular, rounded or polygonal cross-sections. The present invention provides alternate embodiments for those rods, improving their design for some applications.

SUMMARY OF THE INVENTION

The present invention relates to tube presses, and in particular to a tube press of relatively simple construction that is convenient and easy to use.

It is an object of the present invention to provide effective assistance in the manual dispensing of the contents of collapsible tube dispensers. It is a further object of the present invention to provide a device with few components, having the ability to supply sufficient squeezing pressure to collapsible tube dispensers.

It is another object of the present invention to provide a device that can accommodate a range of collapsible tube thicknesses, while still providing effective squeezing pressure.

Still another object of the present invention is to provide a device which, when left on a collapsible tube dispenser, will remain in place, rather than slide back down towards the closed end of the tube.

Other objects and advantages of the present invention are apparent in the disclosure which includes the above and ongoing specification and claims and drawings.

A preferred embodiment of the invention has two oblongated rods positioned in parallel, each with aligned notches to guide and hold two bands or O-rings at each end. The O-rings exert a pressure on the rods, which is in turn exerted on a tube which is sandwiched between the rods. The apparatus slides onto the end of a tube and then along the length of the tube, forcing the residual paste to the top. The rods do not roll freely along the tube once the tube is inserted because of the oblongates edges, but rather stay in fixed relative position because of inward circumferential forces of the O-rings. This is in part due to longitudinal oblongated edges on the rods which resist non-manual revolution. The O-rings naturally cause the rods to abut at the nearest, shortest radii, which in the case of the present invention are arcs which join the oblongations on the rods.

The basic invention consists of two identical-sized oblongated rods positioned side by side and held together at each end by two O-rings. The rods are grooved on both ends along the diameter of the rod so that the channel will prevent the 0-ring from slipping off. The O-rings hold the rods together, provide tension between the opposing rods, and allow the rods to rotate against each other. Oblongations on the opposing rods resist non-manual rotation and disallow slippage back down the tube.

The tube press is used by simply slipping the end of the tube between the two rods and sliding the tube press up along the length of the tube as the tube empties. The tension between opposing rods produces a squeezing action that forces the toothpaste up to the top of the tube.

The oblongated edges of the rods mate with each other to form a gradual tube-receiving means towards the rod abutments or nip, which improves over prior art. Formerly, rounded rods were held together and the tube was pushed or rolled between them. The round rods do not provide a gradual entrance slot into the press that readily overcomes the inward circumferential force as applied by the O-rings. On the other hand, a cross-section of the preferred invention shows oblongated rods of uniform construction, wherein the O-rings hold the rods together at the points of least resistance, or at some point on the circumferences of the rods away from the oblongations. An arc is provided between the oblongations of a rod at the abutment, and the arc or curve forms a side to the tube-receiving slot which has a slope that is more gradual than that of a round rod, thus more readily accommodating the tube.

Because of the narrow profile and constant tension of the present invention, it can be placed on a brand new tube where it will remain clipped on firmly. This will prevent it from being lost, i.e., in the medicine cabinet, and will insure the user will have it when the tube begins to empty. Other devices cannot be placed on until the tube is partially empty.

The use of O-rings to provide tension has several notable advantages over other inventions designed for tube squeezing. The fact that tension is applied to the tube allows this device to work more effectively than fixed slot type inventions. The use of O-rings will also allow the invention to easily accommodate tubes of different thicknesses, unlike devices using mechanically fixed rollers. The use of O-rings allow the device to be compact and uncumbersome. Principal designs for the present rods evolve from the basic shape as formed by a cross-section oblongated sphere or polygon. Preferred shapes include ellipses (or football shapes) and polygons with arcs or bevels adjacent the abutment.

When the device is first placed onto the bottom of the tube, the gradual slopes of the sides of the entrance slot of the press help to facilitate the operation of getting the press onto the tube. Further, the oblongations of the rods can be slight to facilitate a rolling action, which helps the user overcome the tension between the two rods. The amount of sliding and the amount of rolling involved in this operation varies according to the amount of oblongation.

Previously, attempts to place the press onto the tube by pushing directly against the circular slopes of the sides of the entrance slot of the press, the act of placing the press onto the tube can be a very difficult operation. However, the operation is much easier with the present invention because the entrance slopes are more gradual and allow for wedging of the rods apart at the abutment.

When the press is being applied, it is more of a sliding action rather than a rolling action, especially in highly oblongated rods. It has been found that during non-use a circular cross-sectioned rod tends to revolve away from the material inside. The oblongations on the rod of the present invention allow for some manual rotation and squeezing of the material, but sufficiently resist back pressure that causes the backwards revolution during non-use.

Besides providing a means for gradually wedging the rods apart and resisting backwards revolution, the present invention also has other advantages. The rods can have elliptical cross-sections with opposite oblongations. This provides the gradual slopes on one side of the slot, with the opposite oblongations providing a complementary function. These can be manually pinched together to further open the slot, and then released when the tube is inserted to roll the press onto the tube. The press can easily slide up the tube after the initial insertion. Fingerholds can be provided on the opposite oblongations. Another option provided is scoring or other frictional surfaces on the natural abutment arcs of the rods (or at the point of least resistance to the O-rings). This provides added resistance to slippage of the press on the tube. Pinching of the opposite oblongations shifts the abutment to smoothed portions of the rods away from the scores, which lessens friction and facilitates movement through the slot.

Another preferred embodiment provides bevels on the sides of the rods. The bevels are sloped to allow easy insertion of the tube.

Ovals, ellipses, trapezoids, kidney-shapes, and elongated polygons with beveled edges are primary forms of cross-sections of the present rods.

The rods could be made from various materials such as plastic, metals, wood or any other material that will maintain the required rigidity. Even hollow rods will function effectively. Of course, colors, finish, and appearance can be tailored to whatever is desired. Rods could come in a smooth finish or a course pebbled finish. The additional friction of a course or pebble finished rod may be more effective on certain types of tubes.

O-rings can be of various materials, e.g., BUNA, urethane, latex, etc. Of course, the tension on the tube press can be adjusted by varying material choice and O-rings thickness and configuration. Configurations may include V-bands, square-bands, rectangular bands, etc.

The end of the rods can be made in a variety of ways.

Rounded ends allow the O-rings to easily be placed on during assembly and gives the product a rounded look.

Flat ends give the product a different look. Beveled-flat ends allow the O-rings to be slipped on easily, but maintains a flat look.

Rounded-flat ends allow the O-rings to be slipped on easily, but maintains a flat look.

Pointed ends allows the rod to be used to pierce sealed tubes.

Combinations of end styles may be used. There could be a round end on one side and flat end on the other. A smiley face imprinted on end, etc.

An interesting design was noted when the rods were made from clear hollow acrylic. Spraying the inside of the rod with paint gave it a very unique appearance because of the clear outer layer of the rod itself. We noted that this idea could be further expanded on by possibly adding liquid, glitter, paper, printing, etc. to the inside of the rods and sealing the ends. This would allow the invention to have a unique appearance and possibly added appeal.

The O-rings in this invention could be substituted by using a C-shaped metal spring. Alternatively, a band of elastic material would run in a continuous loop through the central axis of the two opposing rods. The band would exit one end of a first rod, enter the end of the adjacent rod, and vice versa on the other ends.

No groove would be required, central boreholes will be needed instead.

The present invention has other, less obvious applications. It can be used to flatten other materials such as dollar bills. It makes an effective clip. It can incorporate a logo (such as a dentist's or manufacturer's name) for promotional or instructional use. No exact size or dimension is given for the present invention. Size can vary depending on the application for which it is manufactured.

The present invention can be used in conjunction with an accessory for suspending or holding a tube. The accessory has a flat vertical surface for mounting onto a wall. The accessory may be mounted by hook, magnet, tape, screw, suction-cup, or the like. The accessory has two pockets, one at either end and towards the top of the wall-mounting surface. The pockets are both open on their adjacent sides to accommodate the tube press. The open area between the two pockets is slightly wider than the distance between the two O-rings of the tube press. The holding device may also be mounted on a refrigerator door or medicine cabinet. The holding device may also be mated with a toothpaste holder or cup holder.

A preferred tube press has first and second similar elongated rods. The rods have first and second grooves respectively near the first and second ends. The first and second grooves of the second rod are spaced similarly to the first and second grooves in the first rod. First and second resilient members extend respectively between the first grooves and the second grooves. A nip, or slot, is formed between adjacent longitudinal portions of the elongated rods where they abut. Enlarging or wedging the nip by inserting an end of a tube in the nip tends to stretch the first and second resilient members. The stretching of the first and second resilient members tends to return the nip towards its original condition, whereby a tube within the nip is squeezed.

Preferably resilient members in that embodiment are elastic strings having knotted ends as anchor members.

Preferred tube presses have peripheral grooves, and resilient members are bands having opposite portions mounted in the peripheral grooves.

Preferably the peripheral grooves extend entirely around end portions of the rods.

A preferred method of squeezing a product dispensing tube includes sliding or rolling a nip between first and second rods over a first corner of an end of the tube, with the rods aligned at an angle to an elongated axis of the tube, stretching first and second resilient bands on first and second opposite ends of the rods, receiving the first corner of the tube in the nip, holding one end of the rods near the corner and swinging the rods over the entire end and the opposite second corner, while additionally stretching the second resilient band on the second ends of the rods, and resiliently urging the rods together on the end of the tube with the bands intending to reduce the sides of the nip between the rods, and advancing the rods along the tube, while dispensing a product from the tube.

Other advantages and features of the invention will be apparent from the disclosure, which includes the above and ongoing specification with the claims and the drawings.

BRIEF DESCRIPTION OF THE DRAWINGS

FIG. 1 shows an overall view of the apparatus as it would appear without a tube dispenser between the rods.

FIG. 2 shows the apparatus with a slight gap between the rods, as occurs when a tube is inserted.

FIG. 3 is a side view of the apparatus with oval rods.

FIG. 4 is an isolated view of a band or O-rings.

FIG. 5 is an isolated view of a rod with squared-off grooves.

FIG. 6 is a side view showing insertion of the tube in the prior art with circular cross-sectioned rods.

FIG. 7 shows a preferred embodiment of the present invention showing the oblongated rods with gradually-sloped sides to the entrance slot for insertion of the tube.

FIGS. 8*a* and 8*b* are side and top views of a preferred rod of the present invention.

FIGS. 9*a* and 9*b* are alternative bottom and top views of a rods, showing friction scores and finger holds for pinching and opening the slot for insertion.

FIGS. 10*a* and 10*b* show a preferred cross-section of the invention with rods having beveled entrance sides.

DETAILED DESCRIPTION OF THE DRAWINGS

Figure 11:
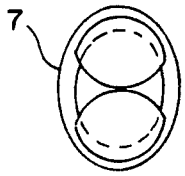
FIGS. 11 and 12 illustrate two ways in which the O-rings may rest in the grooves.

FIG. 1 gives a lengthwise view of the assembled apparatus. An oblongated rod 3 is in contact with and parallel to an identical rod 5. The rods are held in position by means of two bands or O-rings 7, one at each end of the rod assembly. The O-rings or bands fit into grooves 9 in the rod cylinders. When assembled as shown, the O-rings or bands are somewhat stretched, creating tension within the O-rings. The tensile force creates a reactionary compressive force, thereby maintaining the contact between the two cylinders.

FIG. 2 is a similar illustration, showing a lengthwise view of the assembled apparatus with rod 3 and rod 5 being in parallel but having a slight spacing 11 between them, as would occur when a tube is inserted between the rods. The two elastic O-rings 7 stretch slightly to accommodate the tube thickness.

FIG. 3 is a side view of the apparatus with oblongated rods. The rods, in this case, are elliptical or oval. The depth of the grooves 9 is illustrated by the dashed circles. The O-rings 7 are wrapped around the upper rod 3 and lower rod 5 and fit into the grooves.

FIG. 4 illustrates an O-rings 7 as it would appear if removed from the rest of the apparatus.

The isolated view of a rod in FIG. 5 shows one possible shape for the grooves 15 and the rod ends 13. The grooves are squared off, and the rod ends are rounded. Since the rods in the apparatus are identical, a rod such as the one illustrated can be used for both the upper and lower rods when assembled.

FIG. 6 is a cutaway of the prior art, with circular rods and tube to be inserted therebetween. The circular rods 17 abut due to the force of the O-rings (not shown) and form tube insertion slot 19 through which tube 21 is inserted. The sides of the rods 23 proximal the slot 19 are sloped according to the circular cross-section and thus make it difficult to insert the tube. This is because the slopes of the sides 23 are not gradual enough to overcome the tensile strength of the O-rings to allow easy insertion of the tube 21 into the slot 19.

However, FIG. 7 shows a preferred embodiment of the present invention with oblongated, elliptical or oval rods 3. The rods 3 have gradually-sloped slot sides 23, which allow for easier insertion of the tube into the slot 19. Further, manual pressure can be applied to the rear portions 25, as indicated by the arrows 27 to revolve the rod abutment 29 towards the rear 25. This opens the slot 23 for insertion and, when manual pressure is released, rolls the abutment to its original position with the tube securely inserted.

FIG. 8*a* shows a side view of a preferred oval rod 3 with O-rings grooves 15 and rod end 4.

FIG. 8*b* shows a top view of the rod, in this case having an end cross-section 4 of an oblongated ellipse having one side more rounded than the opposite side.

FIGS. 9*a* and 9*b* are bottom and top views 31 and 33 of a preferred rod. The rods have O-rings grooves 15 near the ends 4. The grooves may extend completely around the oval rod. Alternately the grooves may extend over the one outer side and around both ends of a rod. FIG. 9*a* shows friction scores 35 on the bottom of the rod for gripping the sides of the tube to prevent slippage of the tube due to back pressure.

FIG. 9*b* shows finger holds 37 provided for assisting the sliding of the device along the tube, and for pinching one side to open the slot 23, as shown in FIG. 7. This pinching action can revolve the abutment 29 to a non-scored portion 39 in FIG. 9*a*, thus allowing the user to readily slide the apparatus onto the tube as desired.

FIGS. 10*a* and 10*b* show an alternate rod shape, wherein an oblongated rod 41 has bevels 43 which accommodate and facilitate easy insertion of the tube. Further, the bevels allow for gradual pressure to be applied to the tube, as shown in FIG. 10*b*, making the apparatus easier to adjust on the tube. The lifting of the leading portions of the ovals by the tube results in increased pressure at the trailing portions of the oval press member. The lifting of the leading positions of the ovals occurs also in preferred embodiment of FIG. 7, but preferred embodiment in FIG. 10*a* takes further advantage of this effect. This effect does not occur in the present invention incorporating rounded or circular sections.

Besides the advantages of the oblongated rods as mentioned above, the present invention also prevents or retards non-manual slippage of the apparatus on the tube. This is best shown by comparing FIGS. 6 and 7, wherein the circular rods of the prior art are used as opposed to the oblongated rods of the present invention. The circular rods are held onto the tube in place by the tensile strength of the O-rings. However, when the user squeezes the tube to dispense its contents, it has been found that back pressure can cause revolution of the circular rods away from the material inside. On the other hand, the oblongated rods resist rotational movements because of the greater radii of the oblongated ends do not readily revolve around each other. Coupled with the gradual slopes of the entrance slot, the oblongated shape of the rods of the present invention provide substantial improvement over the prior art.

FIG. 11 shows that the O-rings 7 may be entirely recessed within the grooves so that they do not protrude.

Figure 12:
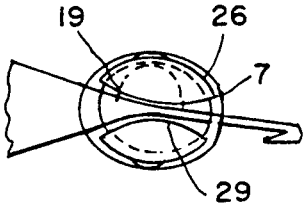

FIG. 12 is an alternate embodiment of FIG. 11 showing the tube inserted between oblongated rods having gradually-sloped slot sides 19. It can be seen that the gradual pinching of the material within the tube is used in conjunction with the tensile strength of the O-rings to provide an efficient means for using the present invention. Further, the tensile strength of the O-ring scores (not shown) at the rod abutment 29 and oblongated sides 26 prevent back-slipping of the apparatus off the tube due pressure applied to the tube during normal use.

Figure 13:
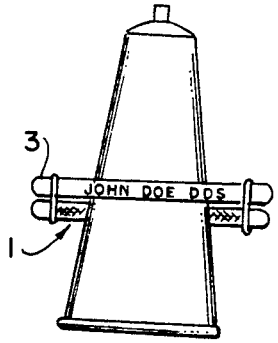
FIG. 13 is a view of the present invention being used on a tube, with personalization and scoring features illustrated.

FIG. 13 shows a preferred embodiment of the present invention in its proper use.

Figure 14:
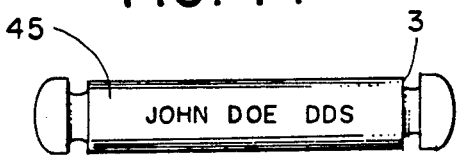
FIG. 14 is a top view of a preferred rod which has been personalized for advertising, promotional or reference means.
Figure 15A:
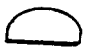
FIGS. 15*a*–15*f* show cross-sections of various elliptical embodiments of the oblongated structures.
Figure 15B:
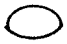
Figure 15C:
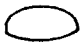
Figure 15D:
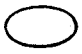
Figure 15E:
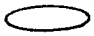
Figure 15F:
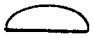

FIG. 14 shows an alternate embodiment of the present invention, wherein the rod 3 incorporates an inscription or sticker 45 to be used for promotional, advertising, directional or similar purposes. Such techniques could be readily used by dentists, toothpaste or glue manufacturers, as well as a variety of others.

FIGS. 15 and 16 show a variety of different cross-sections of rods for the present invention. All are oblongated in nature. FIGS. 15*a*14 15*f* all show oblongated ellipses or ovals having varied side and end dimensions. The opposing sides of a single rod can have different curvatures, and the ends may be rounded or pointed.

The size of the oval presses may vary according to the size of the tubes with which presses are employed.

While the invention has been described with reference to specific embodiments, modifications and variations of the invention may be constructed without departing from the scope of the invention, which is described in the following claims.

We claim:

1. A tube press apparatus for squeezing the contents from tubes comprising:

first and second similarly uniformly elongated rigid rods, each having first and second opposite ends, a top side, bottom side, opposite tube receiving and tube exiting sides, and an oval cross-section;

first and second peripheral grooves extending entirely around end portions of said rods proximal the first and second opposite ends;

said first and second peripheral grooves of said second rod being spaced similarly to the first and second peripheral grooves of said first rod;

a resilient means for holding and abutting the bottom sides of the elongated rods parallelly together to form a nip therebetween;

said resilient means comprising first and second elastomeric O-rings extending respectively between and engaging the first and second peripheral grooves of each rod respectively and extending outwardly around the first and second rods, each of the first and second elastomeric O-rings having a first portion for positioning in the respective first or second peripheral grooves of the first rod and having a second portion for positioning in the respective first or second peripheral grooves of the second rod;

said first and second elastomeric O-rings providing an inward force on the nip for squeezing the tube;

a slope means formed between the tube receiving side and bottom side of each rod for gradually pinching a tube into said nip;

said slope and said nip forming a slot for inserting and squeezing said tube therein;

whereby insertion of the tube in said slot causes said nip to enlarge and said elastomeric O-rings to stretch, whereby the stretching of said elastomeric O-rings causes said nip to return to its unenlarged original condition, whereby the tube between the nip is squeezed.

2. The tube press apparatus of claim 1, further comprising the rods of the press having friction-enhancing means which resist non-manual sliding of the apparatus on the tube.

3. The rods of claim 2, further comprising the friction enhancing means being scores on the bottoms of the rods.

4. The tube press apparatus of claim 1, further comprising finger holds being formed between said top and at least one of the sides of the rods for squeezing first and second opposite sides of the tubes towards one another, and revolving the nip towards that side for allowing easier insertion of the tube into the apparatus and changing the location of the nip.

5. The tube press apparatus of claim 1, wherein the rods have elliptical cross-sections.

6. The tube press apparatus of claim 1, wherein the slope between the tube-receiving side and the bottom of each tube is provided by a bevel for gradually pinching the tube towards the nip formed at the abutment of the bottoms of the rods.

7. A squeezing apparatus for effectively removing the contents of collapsible plastic tube means, comprising:

two substantially identical parallelly elongated rods, a groove near each end of both rods extending about the perimeter of rod and perpendicular to the lengthwise axis of the rod, each rod having a oval cross-section with a top, bottom, tube-receiving side and tube exit side;

a diameter of the elongated rod between the tube-receiving and exit sides being greater than that of an opposite side, a slope formed between the tube-receiving side and bottom for gradually squeezing the tube towards a nip;

tow identical O-rings of elastic material that fit into the grooves of both rods, holding the two rods in parallel and maintaining contact between the rods in the absence of a intervening object by means of elastic tension, and further maintaining in stationary relation with the rods in the presence of an intervening object by means of forcing the rods to abut at the nip on the bottoms because of circumferential inward force caused by the elastic rings, tending to resist outward force applied at the nip, thus squeezing the tube.

8. The tube press apparatus of claim 7, further comprising the rods having friction-enhancing means which resist non-manual sliding of the apparatus on the tube.

9. The rods of claim 8, further comprising the friction enhancing means being scores on the bottoms of the rods.

10. The tube press apparatus of claim 7, further comprising finger holds being formed between the top and at least one of the sides of the rods for squeezing first and second opposite sides of the tube means towards one another, and revolving the nip towards that side for allowing easier insertion of the tube into the apparatus and changing the location of the nip.

11. The tube press apparatus of claim 7, wherein the rods have elliptical cross-sections.

12. The tube press apparatus of claim 7, wherein the slope between the tube-receiving side and the bottom of each tube is provided with a bevel for gradually pinching the tube towards the nip formed at the abutment of the bottoms of the rods.

* * * * *